US005143378A

United States Patent [19]

Joel

[11] Patent Number: 5,143,378

[45] Date of Patent: Sep. 1, 1992

[54] HEALTH GAME

[76] Inventor: Deborah L. Joel, 2127 Ashburton St., Baltimore, Md. 21216

[21] Appl. No.: 641,203

[22] Filed: Jan. 15, 1991

[51] Int. Cl.[5] ..... A63F 3/00

[52] U.S. Cl. ..... 273/243

[58] Field of Search ..... 273/242, 243, 244, 246

[56] References Cited

U.S. PATENT DOCUMENTS

| | | | |
|---|---|---|---|
| 895,128 | 8/1908 | Trant | 273/243 |
| 2,415,073 | 2/1947 | Buffmire | 273/243 |
| 3,989,251 | 11/1976 | Barlow | 273/243 X |
| 4,040,628 | 8/1977 | Pope . | |
| 4,159,117 | 6/1979 | Kuna . | |
| 4,273,337 | 6/1981 | Carrera | 273/243 |
| 4,279,422 | 7/1981 | Shaw | 273/243 X |
| 4,372,559 | 2/1983 | Summers | 273/243 |
| 4,718,675 | 1/1988 | Rosenberg | 273/243 |

FOREIGN PATENT DOCUMENTS

| | | | |
|---|---|---|---|
| 2380044 | 10/1978 | France | 273/243 |
| 2554359 | 5/1983 | France . | |
| 2544624 | 10/1984 | France . | |
| 1482321 | 8/1977 | United Kingdom . | |
| 2084027 | 4/1982 | United Kingdom . | |
| 2186497 | 8/1987 | United Kingdom . | |

*Primary Examiner*—Theatrice Brown
*Assistant Examiner*—William E. Stoll
*Attorney, Agent, or Firm*—David Newman & Associates

[57] ABSTRACT

An educational device employing a game situation to teach preventive health care concepts to the family. The educational device generally includes a playing board apparatus having a plurality of spaces defining a travel path, a plurality of playing pieces, and a chance device for determining the advancement of the playing pieces along the travel path. Also included are health problem squares, preventive health care squares, a match card, question-answer cards, score point cards, penalty point cards, preventive health care certificates, water boy squares, and direction squares. The Health Game simulates a real life situation where players are confronted with health problems. The health problems acquired by the players may be overcome by possessing the appropriate preventive health care certificate.

15 Claims, 3 Drawing Sheets

FIG. 2
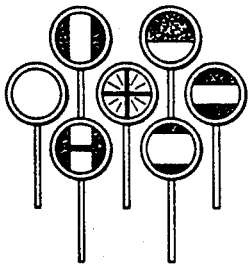
FIG. 3
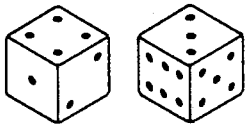
FIG. 4
151. RABIES IS A DISEASE SPREAD BY
A. HUMANS
B. ANIMALS
C. PLANTS
ANS: ANIMALS
FIG. 5
A.I.D.S.
FIG. 6
NONSMOKER HEALTH CERTIFICATE
FIG. 7
EXERCISER
FIG. 8
WATER BOY

FIG. 9

ADVANCE FIVE SPACES

FIG. 10

NONSMOKER

120

FIG. 11A

PENALTY POINT CARD

200 PENALTY POINTS

FIG. 11B

PENALTY POINT CARD

500 PENALTY POINTS

FIG. 11C

PENALTY POINT CARD

1000 PENALTY POINTS

FIG. 12A

SCORE POINT CARD

200 PENALTY POINTS

FIG. 12B

SCORE POINT CARD

500 PENALTY POINTS

FIG. 12C

SCORE POINT CARD

1000 PENALTY POINTS

HEALTH GAME

BACKGROUND OF THE INVENTION

The present invention relates to board games and more particularly to board games which may be played by persons of varying ages and which have the combined purposes of providing entertainment and education in the health care discipline.

DESCRIPTION OF THE PRIOR ART

There are known in the art a large variety of board games based on and directed to various situations, such as financial games, athletic games, dieting games, and the like. However, so far as is known no board games have been developed around the theme of health games having different health problems and preventive health situations, with an object of teaching health education and for prevention of health problems and health care.

OBJECT AND SUMMARY OF THE INVENTION

An object of the invention is to provide a health game for teaching health education.

Another object of the invention is to provide a health game for prevention of health problems and teaching health care.

A further object of the invention is to provide a health game which simulates a real to life situation where players are confronted with health problems that threaten an otherwise healthy life.

According to the present invention, as embodied and broadly described herein, a board game is provided comprising manually manipulable means, a plurality of playing pieces, a plurality of health question cards, and a game board. The manually manipulable means bear indicia for making a chance selection, and may be embodied as one or more dice. The plurality of playing pieces each represent a player. The plurality of health question cards contain player questions. The game board has a playing surface, with a first series of playing locations, a second series of playing locations, and a third series of playing locations. The first series of playing locations, defined about the playing surface of the playing board around the perimeter of the playing surface, is in substantially contiguous relationship and comprise's a playing path in which the playing pieces are moved in discrete steps between successive locations. The second series of playing locations is defined about the playing surface in substantially contiguous relationship and is located within the first series of playing locations. The second series of playing locations comprises a playing path in which the playing pieces are moved in discrete steps between successive locations. The first series of playing locations includes at least one location that a player whose piece lands thereon is to move to the second series of playing locations.

The third series of playing locations is defined about the playing surface in substantially contiguous relationship and located within the first and second series of playing locations. The third series of playing locations comprises of playing path in which the playing pieces are moved in discrete steps between successive locations. The second series of playing locations includes at least one location that a player whose piece lands thereon is to move to the third series of playing locations. The first, second and third series of playing locations include at least one location indicating that a player whose piece lands thereon contracts a health problem, at least one location indicating a player whose piece lands thereon obtains a preventive health care certificate, and at least one location providing that player whose piece lands thereon follows a game direction.

Additional objects and advantages of the invention are set in part in the description which follows, and in part are obvious from the description, or may be learned by practice of the invention. The objects and advantages of the invention also may be realized and attained by means of the instrumentalities and combinations particularly pointed out in the appended claims.

BRIEF DESCRIPTION OF THE DRAWINGS

The accompanying drawing, which is incorporated in and constitutes a part of this specification, illustrates a preferred embodiment of the invention, and together with the description serves to explain the principles of the invention.

FIG. 2 illustrates playing pieces;

FIG. 3 shows a pair of dice;

FIG. 4 illustrates health question cards having player questions;

FIG. 5 illustrates a health problem square;

FIG. 6 illustrates a preventive health care certificate;

FIG. 7 illustrates an exerciser square;

FIG. 8 illustrates a water boy square;

FIG. 9 illustrates a square with a game direction

FIG. 10 illustrates a preventive health care square;

FIGS. 11A–11C illustrate penalty point cards; and

FIGS. 12A–12C illustrate score point cards.

DETAILED DESCRIPTION OF THE PREFERRED EMBODIMENTS

Figure 1:
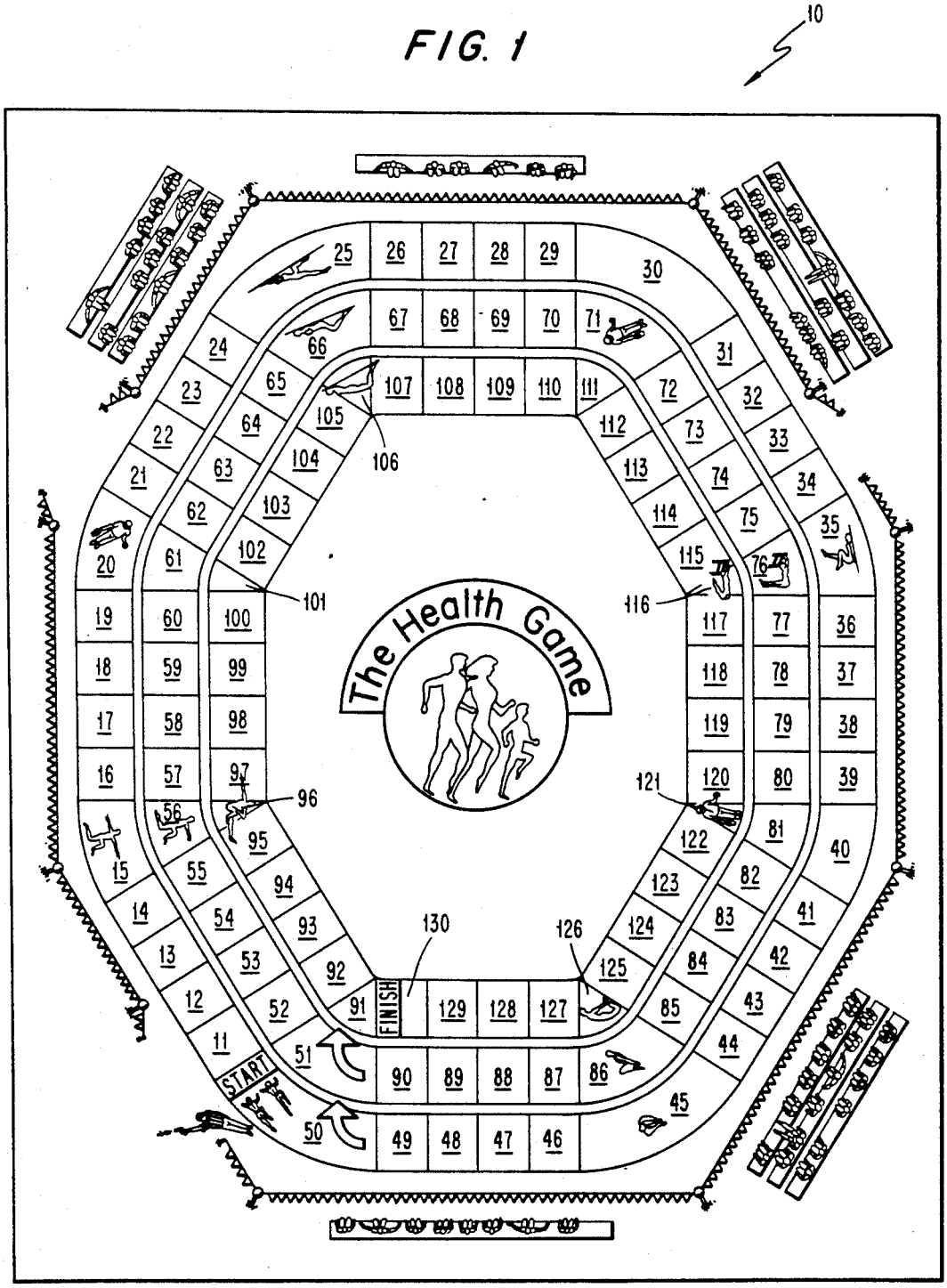
FIG. 1 shows a playing board constructed in accordance with a preferred embodiment of the invention.

Reference will now be made to the present preferred embodiments of the invention, examples of which are illustrated in the accompanying drawing, wherein like reference numerals indicate like elements throughout the several views.

Referring to FIG. 1 a playing board for a health game is shown constructed in accordance with an embodiment of the present invention. The playing board includes a playing surface defined on a base, and having a plurality of playing locations disposed contiguously on the playing surface.

The board game according to the present invention, includes manually manipulable means, a plurality of playing pieces, as illustrated in FIG. 2, a plurality of health question cards, and a game board. The manually manipulating means bear indicia for making a chance selection, and may be embodied as a pair of dice, as shown in FIG. 3. The plurality of playing pieces of FIG. 2 each represent a player. The plurality of health question cards of FIG. 4 contain player questions. The manually manipulable means, typically a pair of conventional dice, but not forming part of the playing board, are provided for determining a player's move.

More particularly, as shown in FIG. 1, a game board is provided comprising a playing surface thereon having a first series of playing locations, a second series of playing locations, and a third series of playing locations. The first series of playing locations is defined about the perimeter of the playing surface of the game board in substantially contiguous relationship having the shape of an octagon. The first series of playing location comprises a playing path which the playing pieces are moved in discrete steps between successive locations.

The second series of playing locations is defined about the playing surface in substantially contiguous relationship having the shape of the octagon and is located within the first series of playing locations. The second series of playing locations comprises a playing path in which the playing pieces are moved in discrete steps between successive locations. The first series of playing locations includes at least one location that a player whose piece lands thereon is to move to the second series of playing locations.

The third series of playing locations is defined about the playing surface in substantially contiguous relationship having the shape of the octagon and located within the first and second series of playing locations. The third series of playing locations comprises a playing path in which the playing piece are moved in discrete steps between successive locations. The second series of playing locations include at least one location that a player whose piece lands thereon is to move to the third series of playing locations.

Playing locations include at least one location indicating that a player whose piece lands thereon contracts a health problem, as illustrated in FIG. 5 at least one location providing that player whose piece lands thereon obtains a preventive health care certificate , as illustrated in FIG. 6 and at least one location providing that a player whose piece lands thereon follows a game direction as illustrated in FIG. 7.

In the embodiment of the invention illustrated in FIG. 1 are provided a start location 50, a plurality of numbered locations and a finish location 130. Many of the numbered locations contain instructions to a participant whose playing piece lands on the numbered location. An exemplary listing of a set of suitable instructions is provided herein below:

| | | |
|---|---|---|
| 11. | START | |
| 12. | Drug Free | 500 Score Points |
| 13. | Stroke | 500 Penalty Points |
| 14. | Calcium Supplement | 200 Score Points |
| 15. | Exerciser | |
| 16. | Drug Abuser | 500 Penalty Pts |
| 17. | Crisis Suicide Hotline | 1000 Score Pts |
| 18. | Stress | 200 Penalty Pts |
| 19. | Nonsmoker | 500 Score Pts |
| 20. | Water Boy | |
| 21. | High Blood Pressure | 500 Penalty Pts |
| 22. | Dental Hygiene & Checkup | 200 Score Pts |
| 23. | Lung Cancer | 500 Penalty Pts |
| 24. | Condoms | 1000 Score Pts |
| 25. | Stretch Exerciser | |
| 26. | Diet Card 2 | 500 Score Pts |
| 27. | Dental Hygiene & Checkup | 200 Score Pts |
| 28. | Lung Cancer | 500 Penalty Pts |
| 29. | Condoms | 1000 Score Pts |
| 30. | ADVANCE 5 SPACES | |
| 31. | Diabetes | 500 Penalty Pts |
| 32. | Iron Supplements | 200 Score Pts |
| 33. | Drug Abuser | 500 Penalty Pts |
| 34. | Seat Belts | 500 Score Pts |
| 35. | Exerciser | |
| 36. | Suicidal | 1000 Penalty Pts |
| 37. | Family Planning | 200 Score Pts |
| 38. | Overweight | 200 Penalty Pts |
| 39. | Seat Belts | 500 Score Pts |
| 40. | LOSE 1 TURN | |
| 41. | Anemia | 500 Penalty Points |
| 42. | Alcohol Free | 500 Score Pts |
| 43. | Osteoporosis | 500 Penalty Pts |
| 44. | Crisis Suicide Hotline | 1000 Score Pts |
| 45. | EXERCISER | |
| 46. | Automobile Injury | 500 Penalty Pts |

-continued

| | | |
|---|---|---|
| 47. | Alcohol Free | 500 Score Pts |
| 48. | Unplanned Pregnancy | 200 Penalty Pts |
| 49. | Diet Card 1 | |
| 50. | Start Block for Turning Lane | |
| 51. | LOSE 1 TURN | |
| 52. | Condoms | 1000 Score Pts |
| 53. | Cavities | 500 Penalty Pts |
| 54. | Vacation | 500 Score Pts |
| 55. | Heart Disease | 500 Penalty Pts |
| 56. | EXERCISER | |
| 57. | Diet Card 3 | 500 Score Pts |
| 58. | Alcohol Abuser | 500 Penalty Pts |
| 59. | Vacation | 500 Score Pts |
| 60. | Diverticular Disease | 500 Penalty Pts |
| 61. | GO BACK 2 SPACES | |
| 62. | Nonsmoker | 500 Score Pts |
| 63. | AIDS | 1000 Penalty Pts |
| 64. | Drug Free | 500 Score Pts |
| 65. | High Blood Pressure | 500 Penalty Pts |
| 66. | Floor Exerciser | |
| 67. | Stroke | 500 Penalty Pts |
| 68. | Calcium Supplement | 200 Score Pts |
| 69. | Drug Abuser | 500 Penalty Pts |
| 70. | Crisis Suicide Hotline | 1000 Score Pts |
| 71. | REST STOP | |
| 72. | Stress | 500 Penalty Pts |
| 73. | Nonsmoker | 500 Score Pts |
| 74. | Diet Card 2 | 500 Score Pts |
| 75. | Dental Hygiene & Checkup | 200 Score Pts |
| 76. | Exerciser | |
| 77. | Lung Cancer | 500 Penalty Pts |
| 78. | Condoms | 1000 Score Pts |
| 79. | Diabetes | 500 Penalty Pts |
| 80. | Iron Supplements | 200 Score Pts |
| 81. | ADVANCE 4 SPACES | |
| 82. | Drug Abuser | 500 Penalty Pts |
| 83. | Seat Belts | 500 Score Pts |
| 84. | Suicidal | 1000 Penalty Pts |
| 85. | Family Planning | 200 Score Pts |
| 86. | Exerciser | |
| 87. | Overweight | 200 Penalty Pts |
| 88. | Seat Belts | 500 Score Pts |
| 89. | High Fiber Diet | 500 Score Pts |
| 90. | Alcohol Free | 500 Score Pts |
| 91. | GO BACK 7 SPACES | |
| 92. | Osteoporosis | 500 Penalty Pts |
| 93. | Crisis Suicide Hotline | 1000 Score Pts |
| 94. | Automobile Injury | 500 Penalty Pts |
| 95. | High Fiber Diet | 500 Score Pts |
| 96. | Exerciser | |
| 97. | Unplanned Pregnancy | 200 Penalty Pts |
| 98. | Diet Card 1 | 500 Score Pts |
| 99. | Condoms | 1000 Score Pts |
| 100. | Cavities | 200 Penalty Pts |
| 101. | LOSE 1 TURN | |
| 102. | Vacation | 500 Score Pts |
| 103. | Heart Disease | 500 Penalty Pts |
| 104. | Diet Card 3 | 500 Score Pts |
| 105. | Alcohol Abuser | 500 Penalty Pts |
| 106. | Exerciser | |
| 107. | Vacation | 500 Score Pts |
| 108. | Diverticular Disease | 500 Penalty Pts |
| 109. | Nonsmoker | 500 Score Pts |
| 110. | AIDS | 1000 Penalty Pts |
| 111. | GO BACK 10 SPACES | |
| 112. | Drug Free | 500 Score Pts |
| 113. | High Blood Pressure | 500 Penalty Pts |
| 114. | Stroke | 500 Penalty Pts |
| 115. | Calcium Supplement | 200 Score Pts |
| 116. | Exerciser | |
| 117. | Drug Abuser | 500 Penalty Pts |
| 118. | Crisis Suicide Hotline | 1000 Score Pts |
| 119. | Stress | 500 Penalty Pts |
| 120. | Nonsmoker | 500 Score Pts |
| 121. | Water Boy | |
| 122. | Diet Card 2 | 500 Score Pts |
| 123. | Dental Hygiene & Checkup | 200 Score Pts |
| 124. | Lung Cancer | 500 Penalty Pts |
| 125. | Condoms | 1000 Score Pts |
| 126. | EXERCISER | |
| 127. | Diabetes | 500 Penalty Pts |
| 128. | Iron Supplements | 200 Score Pts |

-continued

| | | |
|---|---|---|
| 129. | Anemia | 500 Penalty Pts |

The start location 50 may also serve as a location where a player whose piece lands thereon is to move to the second series of playing locations at location 51, and the location 51 also may serve as the location where a player whose piece lands thereon is to move to the third series of playing locations at location 91.

Interspersed among the numbered locations are the first plurality of locations indicating that a player whose piece lands thereon contracts a health problem as illustrated in FIG. 5. The first plurality of locations includes, but is not limited to, stroke 12, drug abuser 16, stress 18, high blood pressure 21, lung cancer 23, lung cancer 28, diabetes 31, drug abuser 33, suicidal 36, cavities 53, heart disease 55, alcohol abuser 58, diverticular disease 60, AIDS 63, high blood pressure 65, stroke 67, drug abuser 69, stress 72, diabetes 79, overweight 87, osteoporosis 92, automobile injury 94, unplanned pregnancy 97, and additional health problems as indicated above.

Interspersed among the numbered locations are a second plurality of playing locations indicating that a player who lands thereon obtains a preventive health care certificate, as illustrated in FIG. 6. These playing locations include, but are not limited to, drug free 11, calcium supplement 14, non-smoker 19, condoms 24, dental hygiene and checkup 27, iron supplement 32, seat belts 34, family planning 37, alcohol free 42, vacation 54, non-smoker 62, family planning 85, high fiber diet 95, crisis suicide hotline 118, dental hygiene and checkup 123, and other locations as indicated above. In addition, also shown in FIG. 1 are Exerciser squares as illustrated in FIG. 7, at locations 15, 25, 35, 45, 56, 66, 76, 86, 96, 106, 116, squares, as illustrated in FIG. 8 are also indicated at locations 20, 71, 121. Additional squares may be included having game directions such as move backwards and advance as illustrated in FIG. 9.

The health game of the present invention describes health problems for nearly all the ten leading causes of death in the United States, in a preferred embodiment. Leading authorities have defined preventive health care principles for specific health problems, and these concepts are set forth in the health game. Health problems and preventive actions are presented in a special order to help facilitate the health education learning process in the present invention. The health game is played in the setting of a "track and field race game" where players move a total of three laps around the board, by throwing of dice beginning at the start location 50 and ending at the finish location 130. There are a total of 116 game board location, and preferred embodiment of the present invention, represented in five categories: health problem squares, preventive health care locations, as illustrated in FIG. 10, exercise locations, rest stop locations, direction locations. As the players proceed around the game board, the players acquire penalty points and score points through penalty point cards, as illustrated in FIG. 11, and through score point cards, as illustrated in FIG. 12, respectively. At the end of the race, the player's acquired total number of penalty points are subtracted from the total number of score points. The player with the highest number of score points wins the game. Note, that the winner of the game is not the player who finishes the game first, but rather the player who finishes the game with the race with the highest number of score points. The player that finishes the race first, however, receives bonus score points.

The present invention utilizes dice, player pieces, preventive health care certificates, score point cards, health question cards and match cards. According to the present invention, a player starts from the start location 50 and throws the dice. The player moves around the board and his options depend on which location the player's playing piece lands on. If the player lands on a preventive health care location, as illustrated in FIG. 10 then the player receives a preventive health care certificate, as illustrated in FIG. 6 to match the preventive health care location, as indicated by the match card. The player scores the points indicated in that square.

According to the present invention, if a player's playing piece lands on a health problem location, the player has two options. The first option, the player holding the appropriate preventive health care certificate to match the health problem will not receive a penalty point and waits until the next turn. The second option, the player with the preventive health care certificate selects a question to earn more score points. If the player provides the correct response to the question from the question card, then the player earns a double score point from the location. If the player provides an incorrect response, then the player does not earn extra points but no penalty points are received.

If the player lands on a health problem location, and the player is without the appropriate preventive health care certificate then the player has two choices. First, the player receives penalty points as indicated in that location, and waits until the next turn. Second, the player may alternatively, answer a question. If the player provides the correct response to the question then the player does not receive any penalty points from the health problem location but receives the score points on the location. If, instead, the player provides an incorrect response to the question, then the player receives double penalty points from the health problem location.

In order to determine the appropriate preventive health care certificate for the health problem location, a player examines the match card. Score point cards are used to keep record of score points earned. Penalty point cards are used to keep record of penalty points received. To distinguish preventive health care location from health problem locations see the match card.

During the normal play of the game, a player throws dice and moves his playing piece to the appropriate number of locations according to the throw of the dice. If the playing piece lands on an exercise picture, Exerciser square, as illustrated in FIG 7, then the player receives 500 score points. If the playing piece lands on a water boy square, as illustrated in FIG. 8, then this is a rest stop, and the player neither receives score points nor penalty points. If the playing piece lands on a direction location, then the player must follow the directions indicated on the location. Direction locations include the spaces, lose one turn, go back ten spaces, advance four spaces, etc.

Below is the match card as according to the present invention.

| Game Squares HEALTH PROBLEMS | MATCH CARD Game Squares PREVENTIVE HEALTH CARE | PREVENTIVE HEALTH CARE CERTIFICATE |
|---|---|---|
| A.I.D.S. | CONDOM | NO AIDS HEALTH CERTIFICATE |
| ALCOHOL ABUSER | ALCOHOL FREE | NO ALCOHOL CONSUMPTION HEALTH CERTIFICATE |
| ANEMIA | IRON SUPPLEMENT | IRON SUPPLEMENT HEALTH CERTIFICATE |
| AUTOMOBILE INJURY | SEAT BELTS | SEAT BELT HEALTH CERTIFICATE |
| CAVITIES | DENTAL HYGIENE & CHECKUP | DENTAL HYGIENE HEALTH CERTIFICATE |
| DIABETES | REDUCE FAT, CONTROL CALORIES INCREASE STARCH AND FIBER | NO DIABETES HEALTH CERTIFICATE |
| DIVERTICULAR DISEASE | HIGH FIBER DIET | HIGH FIBER DIET HEALTH CERTIFICATE |
| DRUG ABUSER | DRUG FREE | DRUG FREE HEALTH CERTIFICATE |
| HEART DISEASE | REDUCE FAT, CONTROL CALORIES REDUCE SODIUM | GOOD HEART HEALTH CERTIFICATE |
| HIGH BLOOD PRESSURE | REDUCE FAT, CONTROL CALORIES REDUCE SODIUM | GOOD BLOOD PRESSURE HEALTH CERTIFICATE |
| LUNG CANCER | NONSMOKER | NONSMOKER HEALTH CERTIFICATE |
| OSTEOPOROSIS | CALCIUM SUPPLEMENT | CALCIUM SUPPLEMENT HEALTH CERTIFICATE |
| OVERWEIGHT | LOW CALORIE DIET or EXERCISE | GOOD WEIGHT HEALTH CERTIFICATE |
| STRESS | VACATION or EXERCISE | VACATION CERTIFICATE or EXERCISE |
| SUICIDAL | CRISIS SUICIDE HOTLINE | HOTLINE HEALTH CERTIFICATE |
| UNPLANNED PREGNANCY | FAMILY PLANNING | FAMILY PLANNING HEALTH CERTIFICATE |

HEALTH QUESTION CARDS

Also provided is a plurality of health question cards which are normally maintained in a face down shuffled condition on the playing surface. The health question cards bear the following questions:

1. The largest body organ among the following are:
   a. Heart
   b. Liver
   c. Spleen
   Answer: b. Liver
2. The kidney functions in the body to:
   a. Filter the blood
   b. Regulates digestion of foods
   c. Stimulates insulin secretion
   Answer: a. Filter the blood
3. Measles is usually a childhood disease and is:
   a. Not contagious
   b. Slightly contagious
   c. Highly contagious
   Answer: c. Highly contagious
4. Fever occurs when:
   a. Body temperature is above 98.6 F.
   b. Body temperature is 90.6 F.
   c. Sun bathing
   Answer: a. Body temperature is above 98.6 F.
5. AIDS is caused by a:
   a. Virus
   b. Bacteria
   c. Fungus
   Answer: a. Virus
6. Malaria is spread in Africa, Asia and South America by:
   a. Mosquito bites
   b. The sandfly
   c. Skin to skin contact
   Answer: a. Mosquito bites
7. In less developed countries, the main cause of diarrhea is:
   a. Soft food diet
   b. Lack of clean drinking water
   c. Breast milk
   Answer: b. Lack of clean drinking water
8. In the United States, the most important factor associated with the death of babies under 1 year of age is:
   a. Car accidents
   b. Accidents in the home
   c. Low birth weight
   Answer: c. Low birth weight
9. Usually the first sign of pregnancy is:
   a. A missed menstrual period
   b. Increase in weight
   c. Headaches
   Answer: a. A missed menstrual period
10. The normal length of time a woman is pregnant is about
   a. 39 Weeks
   b. 31 Weeks
   c. 49 Weeks
   Answer: a. 39 Weeks
11. Pregnant women who are alcoholics may have a baby born with:
   a. AIDS
   b. Diabetic syndrome
   c. Fetal alcohol syndrome
   Answer: c. Fetal alcohol syndrome 12. The ideal milk choice for infants is:
a. Cows milk
b. Human milk
c. Goat milk
Answer: b. Human milk
13. Obesity is caused by:
a. Excess cholesterol
b. Excess calories
c. Serotonin secretion
Answer: b. Excess calories
14. Childhood obesity can lead to:
a. Adult obesity
b. Achalasia
c. Esophagitis
Answer a. Adult obesity
15. The flour that has the highest amount of vitamin E:
a. Soybean flour
b. Rye flour
c. Whole wheat flour
Answer: c. Whole wheat flour
16. Liver is an excellent source of:
a. Vitamin K
b. Vitamin E
c. Vitamin A
Answer: c. Vitamin A
17. Oranges, grapefruit and lemons are rich sources of:
a. Vitamin E
b. Vitamin A
c. Vitamin C
Answer: c. Vitamin C
18. The vitamin that is formed in the human intestinal tract is:
a. Vitamin D
b. Vitamin B1
c. Vitamin K
Answer: c. Vitamin K
19. Additional vitamin K is needed by the person who is taking:
a. Antihistamines
b. Aspirin
c. Antibiotics
Answer: c. Antibiotics
20. Carrots are a good source of:
a. Vitamin B1
b. Carotene
c. Vitamin B2
Answer: b. Carotene
21. Vitamin A has a role in:
a. Taste
b. Hearing
c. Vision
Answer: c. Vision
22. The vitamin to prevent night blindness is:
a. Vitamin C
b. Vitamin A
c. Vitamin D
Answer: a. Vitamin A
23. The vitamin to prevent rickets is:
a. Vitamin C
b. Vitamin A
c. Vitamin D
Answer: c. Vitamin D
24. Albumin is a type of protein found in:
a. Wheat
b. Corn
c. Egg
Answer: c. Egg
25. The best source of Vitamin C is:
a. Citrus fruit
b. Sugar
c. Fish
Answer: a. Citrus fruit
26. The vitamin folic acid is found in:
a. Liver
b. White flour
c. Irish potatoes
Answer: a. Liver
27. The best food source of Vitamin B12 is:
a. Vegetables
b. Bread
c. Liver
Answer: c Liver
28. The best food source of the Vitamin Biotin is:
a. Cereal product
b. Wheat flour
c. Liver
Answer: c. Liver
29. The best food source of Vitamin K is:
a. Spinach
b. Apple sauce
c. Corn
Answer: a. Spinach
30. Which food has the highest iron content:
a. Chicken
b. Rice
c. Kidney beans
Answer: c. Kidney beans
31. Which food type has the highest amount of salt:
a. Canned food
b. Frozen food
c. Fresh food
Answer: a. Canned food
32. Potato chips are high in:
a. Potassium
b. Sodium
c. Zinc
Answer: b. Sodium
33. Broccoli is an excellent source of:
a. Calcium
b. Sulphur
c. Copper
Answer: a. Calcium
34. The dairy product that has the highest amount of salt:
a. Butter
b. Processed cheese
c. Yogurt
Answer: b. Processed cheese
35. A protein that is soluble in water and made from collagen is:
a. Casein
b. Ovalbumin
c. Gelatin
Answer: c. Gelatin
36. Mackerel has:
a. Low protein
b. Low fat
c. High fat
Answer: c. High fat
37. The protein found in milk is:
a. Lactose
b. Coloids
c. Lactalbumin
Answer: c. Lactalbumin
38. Vitamin C is added to canned fruit to:
a. Improve texture b. reserve it
c. Aid in digestion
Answer: b. Preserve it 39. Anemia is due to a lack of:
a. Iron
b. Sulfur
c. Copper
Answer: a. Iron 40. Wernicke's disease is related to a deficiency of:
a. Vitamin D
b. Vitamin B
c. Vitamin C
Answer: Vitamin B1

41. Gingivitis is due to a deficiency of:
a. Vitamin C
b. Vitamin B6
c. Vitamin B2
Answer: a. Vitamin C 42. Xeropthalmia is due to a deficiency
a. Vitamin A
b. Vitamin K
c. Vitamin B
Answer: a. Vitamin A 43. Vitamin B12 is not found in:
a. Animal foods
b. Plant foods
Answer: b. Plant foods 44. Pellagra is due to a deficiency of:
a. Vitamin B1
b. Vitamin B2
c. Vitamin B3
Answer: c. Vitamin B3

45. Vitamin B1 is called:
a. Thiamine
b. Riboflavin
c. Niacin
Answer: a. Thiamine 46. Vitamin B2 is called:
a. Riboflavin
b. Thiamine
c. Niacin
Answer: a. Riboflavin 47. Vitamin B3 is called:
a. Riboflavin
b. Thiamine
c. Niacin
Answer: c. Niacin 48. Goiter is due to a deficiency of the nutrient:
a. Zinc
b. Iron
c. Iodine
Answer: c. Iodine 49. Osteoporosis may be due to a deficiency of:
a. Vitamin C
b. Vitamin E
c. Calcium
Answer: c. Calcium 50. A nutrient commonly deficient in the American diet is:
a. Calcium
b. Protein
c. Iron
Answer: c. Iron 51. The most commonly used grain in the world is:
a. Wheat
b. Rice
c. Corn
Answer: b. Rice 52. An elevated blood sugar level is associated with:
a. Hepatitis
b. Coronary artery disease
c. Diabetes mellitus
Answer: c. Diabetes mellitus 53. Cramps during exercise is associated with:
a. Muscle spasm
b. Aerobic oxidation
c. Lactic acid
Answer: c. Lactic acid 54. To reduce dental decay:
a. Increase Vitamin D
b. Decrease concentrated sweets
c. Increase calcium
Answer: b. Decrease concentrated sweets 55. The best food source of dietary fiber is:
a. Sprouts and sees
b. Lettuce and tomatoes
c. Beans and whole grain breads
Answer: c. Beans and whole grain breads 56. The food lowest in fiber is:
a. Lettuce
b. Celery
c. Macaroni
Answer: c. Macaroni 57. An example of a starch food that has empty calories is
a. Pizza
b. Candy
c. Bread
Answer: b. Candy 58. The oil that contains the highest amount of polyunsaturated fatty acid is:
a. Corn Oil
b. Safflower oil
c. Soybean Oil
Answer: b. Safflower Oil 59. A good source of lecithin is:
a. Egg yolk
b. Egg white
c. Milk
Answer: a. Egg yolk 60. The cheese that has the least fat content is:
a. Swiss cheese
b. Muenster cheese
c. Sapsago cheese
Answer: c. Sapsago cheese 61. The food that has the highest concentration of biological protein:
a. Beef
b. Egg
c. Fish
Answer b. Egg 62. Kwashiorkor is a dietary deficiency of:
a. Carbohydrates
b. Protein
c. Fat
Answer: b. Protein 63. Osteoporosis is a disease that results in a reduction of:
a. Calcium in the bone
b. Total bone mass
c. Blood calcium
Answer: b. Total bone mass 64. To consume excess raw egg whites leads to a deficiency of the vitamin:
a. Pyridoxine
b. Biotin c. Folic acid
Answer: b. Biotin 65. Cataracts may be associated with:
a. High blood pressure
b. Diabetes
c. Respiratory illness
Answer: b. Diabetes 66. Teenage mothers have:
a. 1 out of every 4 low birth weight infants
b. 1 out of every 3 low birth weight infants
c. 1 out of every 5 low birth weight infants
Answer: a. 1 out of 4 low birth weight infants 67. Studies have been shown that some infants may be born smaller than normal due to:
a. Lack of the proper enzyme
b. Poor nutritional status of the mother
c. Lack of aerobic exercises
Answer: b. Poor nutritional status of the mother 68. Some scientists have found that infants of women with heroin or methadone addiction are:
a. Slightly overweight at birth
b. Underweight at birth
c. Neither overweight or underweight
Answer: b. Underweight at birth 69. Mothers who are heavy smokers appear to give to their unborn babies:
a. Higher concentrations of carbon dioxide
b. Higher concentrations of carbon monoxide
c. High concentration of oxygen
Answer: a. Higher concentrations of carbon monoxide 70. Premature infants are susceptible to:
a. Fetal alcohol syndrome
b. Respiratory distress syndrome
c. Sleeplessness
Answer: b. Respiratory distress syndrome 71. The number of newborns affected with respiratory distress syndrome each year are:
a. 4,000
b. 40,000
c. 400,000
Answer: b. 40,000

72. Hypoglycemia is a condition of:
a. Low blood sugar
b. High blood sugar
c. Low blood calcium
Answer: a. Low blood sugar 73. Jaundice is caused by an excess of:
a. Hemoglobin in the blood
b. Carbon monoxide
c. Bile pigment in the blood
Answer: c. Bile pigment in the blood 74. Hyperbilirubinemia is.
a. Increased levels of bilirubin in the blood
b. Decreased levels of bilirubin in the blood
c. Neither of the above
Answer: a. Increased levels of bilirubin in the blood 75. To stop the development of hyperbilirubinemia is a newborn it is necessary to:
a. Increase oxygen for long periods of time
b. Expose the infant to artificial light for long periods of time
c. Increase trace metal consumption
Answer: b. Expose infant to artificial light for long periods of time 76. Megaloblastic anemia is due to a deficiency of:
a. Vitamin C
b. Folic Acid
c. Vitamin K
Answer: b. Folic Acid 77. Anorexia nervosa is a disorder of:
a. Iron deficiency
b. Newborns
c. Self-starvation
Answer: c. Self-starvation 78. To help a patient with anorexia nervosa it is necessary to have:
a. Psychotherapy
b. Increase water consumption
c. Increase exercise
Answer: a. Psychotherapy 79. Out of every 200 American girls between the ages of 12 and 18:
a. 10 will develop anorexia
b. 1 will develop anorexia
c. 15 will develop anorexia
Answer b. One will develop anorexia 80. Most patients with anorexia nervosa are:
a. Male
b. Female
Answer: b. Female 81. A test called an electroencephalogram may be given to:
a. Measure heart rate
b. Measure oxygen levels
c. Measure brain activity
Answer: c. Measure brain activity 82. Thermography is an experimental technique for diagnosing:
a. Headaches
b. Lung cancer
c. Diabetes
Answer: a. Headaches 83. The four different types of headaches are vascular headaches, muscle contraction headaches, traction headaches, inflammatory headaches:
a. True
b. False
Answer: a. True 84. Migraines are a type of:
a. Traction headache
b. Inflammatory headache
c. Vascular headache
Answer: c. Vascular headache 85. Migraine headaches are usually characterized by severe pain on both sides of the head, and upset stomach and at times disturbed vision:
a. True
b. False
Answer: a. True 86. Classic migraines start on one side of the head but may eventually spread to the other side. An attack lasts:
a. 1 to 2 days
b. 1 to 2 seconds
c. 1 to 2 minutes
Answer: a. 1 to 2 days 87. Common migraines can cause mood changes, fatigue and unusual retention of fluids:
a. True
b. False
Answer: a. True 88. A common migraine attack can last:
a. 3 or 4 days
b. 3 or 4 minutes c. 3 or 4 weeks
Answer: a. 3 or 4 days 89. A migraine headache can strike as often as several times a week or as rarely as once every few years:
a. True
b. False
Answer: a. True 90. Migraines are more common in adult men than adult women:
a. True
b. False
Answer a. False 91. One of the most commonly used drugs for the relief of classic and common migraines are:
a. Neuraminidase
b. Ergotamine
c. Putrescine
Answer: b. Ergotamine 92. A tension headache is a severe but temporary form of muscle contraction headache:
a. True
b. False
Answer: a. True 93. Brain tumors are diagnosed in about:
a. 11,000 people every year
b. 111,000 people every year
c. 11,000,000 people every year
Answer: a. 11,000 people every year 94. According to a health interview, children age 16 and under that experience migraines and other vascular headaches are:
a. Nearly 100,000
b. Over a million
c. 25 Thousand
Answer: b. Over a million 95. Phenobarbital, cyproheptadine are the names of drugs used to treat migraines in children:
a. True
b. False
Answer: a. True 96. Infarct strokes are usually more severe than hemorrhagic strokes:
a. True
b. False
Answer: b. False 97. Unlike other organs of the body, the brain cannot store energy. It depends upon a continuous supply of fresh blood pumped to it by the heart:
a. True
b. False
Answer: a. True 98. About 25% of the blood the heart pumps goes to the brain:
a. True
b. False
Answer: a. True 99. In the most common form of stroke the blood flow to the brain is blocked or becomes clogged:
a. True
b. False
Answer: a. True 100. The most common warning signs of a stroke are tingling in the limbs, temporary blindness, difficulty of speech:
a. True
b. False
Answer: a. True 101. A medical technique used to take detailed pictures of the arteries of the brain is:
a. Arteriogram
b. Cardiogram
c. Blood glucose test
Answer: a. Arteriogram 102. An anticoagulant is:
a. Substance that increase blood clotting
b. A neutotransmitter
c. Substance that reduces blood clotting
Answer: c. Substance that reduces blood clotting 103. The brain is divided into:
a. 3 Hemispheres
b. 2 Hemispheres
c. 4 Hemispheres
Answer: b. 2 Hemispheres 104. Aphasia is the loss of the ability to make sense of languages including inability to understand printed words:
a. True
b. False
Answer: a. True 105. Influenza is a:
a. Fungus
b. Bacteria
c. Virus
Answer: c. Virus 106. Flu and pneumonia constitutes the:
a. 5th leading cause of death in the U.S.
b. 6th leading cause of death in the U.S.
c. 7th leading cause of death in the U.S.
Answer: b. 6th leading cause of death in the U.S.

107. Rye's syndrome develops in a small number of children and adolescents who are recovering from flu:
a. True
b. False
Answer: a. True 108. Scientists have classified flu viruses into three types—A, B and C:
a. True
b. False
Answer: a. True 109. The first flu virus was identified in the 1930s:
a. True
b. False
Answer: a. True 110. When a virus attaches to a cell in a healthy person, the virus stimulates the person's immune cells to produce:
a. Antibodies
b. Antigens
c. Hemagglutinin
Answer: a. Antibodies 111. Different antibodies are produced in response to each strain of virus:
a. True
b. False
Answer: a. True 112. Viruses for vaccine production are grown in chicken eggs and then inactivated with a chemical so that they are no longer infectious:
a. True
b. False
Answer: a. True 113. In 1987, the people estimated to be infected with the AIDS virus in the United States was:
a. 500,000 b. 250,000
c. 1,500,000
Answer: c. 1,500,000

114. AIDS may be transmitted by:
a. Needle sharing
b. Casual social contact
c. Sneezing and coughing
Answer: a. Needle sharing 115. Dogs, cats and domestic animals are a source of infection for the HIV virus:
a. True
b. False
Answer: b. False 116. Dysmenorrhea is the medical term for:
a. Opportunistic infection
b. Backaches
c. Painful menstruation
Answer: c. Painful menstruation 117. Otosclerosis is:
a. Hereditary hearing problem
b. A blood clot
c. Blood disease
Answer: a. Hereditary hearing problem 118. The number of Americans either totally deaf or suffering significant hearing loss are approximately:
a. 20 thousand
b. 6 million
c. 100 thousand
Answer: b. 6 million 119. A child 4 years of age has a vocabulary of:
a. About 200–300 words
b. About 100–150 words
c. About 300–500 words
Answer: a. About 200–300 words 120. AIDS stands for:
a. Acquired Infection Disease Syndrome
b. Acquired Immune Development Syndrome
c. Acquired Immune Deficiency Syndrome
Answer: c. Acquired Immune Deficiency Syndrome 121. The forebrain is the largest area of the brain and helps to regulate functions like:
a. Information about sight and sound
b. Temperature and blood pressure
c. Controls breathing and heartbeat
Answer: b. Temperature and blood pressure 122. The midbrain regulates:
a. Information about sight and sound
b. Controls breathing and heartbeat
c. Temperature and blood pressure
Answer: a. Information about sight and sound 123. The hindbrain regulates:
a. Information about sight and sound
b. Controls breathing and heartbeat
c. Temperature and blood pressure
Answer: b. Controls breathing and heartbeat 124. The hypothalamus is the brain's emotional center that makes you feel exhilarated, angry or depressed:
a. True
b. False
Answer: a. True 125. Allergy is a disorder of the:
a. Skeletal system
b. Immune system
c. Circulatory system
Answer b. Immune system 126. When a person has an allergy they have:
a. No reaction to environmental substances
b. Hyposensitivity to specific substances
c. Hypersensitivity to specific substances
Answer: c. Hypersensitivity to specific substances 127. Asthma is an obstruction of:
a. Airways into the lungs
b. The blood vessels
c. Passage of food from the stomach
Answer: a. Airways into the lung 128. To treat allergies which of the following are used:
a. Diuretic therapis
b. Excessive sodium intake
c. Antihistamines
Answer: c. Antihistamines 129. Chronic allergis rhinitis, a disorder of the nasal mucosa affects:
a. Thousands of Americans
b. Hundreds of Americans
c. Millions of Americans
Answer: c. Millions of Americans 130. A virus that causes AIDS is:
a. HIV
b. IHV
c. VIH
Answer: a. HIV 131. Genital warts, syphilis, gonorrhea are all examples of:
a. Mental disorders
b. Sexually transmitted diseases
c. Tropical diseases
Answer: b. Sexually transmitted diseases 132. Tropical diseases, especially those caused by parasites afflict nearly:
a. One billion people in the world
b. One million people in the world
c. 100 Million people in the world
Answer: a. One billion people in the world 133. Leishmaniasis is a skin disease caused by:
a. Sexual contact
b. The bite of the sand-fly
c. The bite of a mosquito
Answer: b. The bite of the sand-fly 134. A person is considered to have high blood cholesterol beginning at:
a. 190 mg/dl
b. 240 mg/dl
c. 130 mg/dl
Answer: b. 240 mg/dl 135. Glaucoma is an eye disease. To guard against visual loss people should have regular eye examinations:
a. True
b. False
Answer: a. True 136. Glaucoma is an eye disease and usually begins in:
a. Early childhood
b. Adolescents
c. Middle age or later
Answer: c. Middle age or later 137. Glaucoma affects:
a. 100,000 Adult Americans
b. 6 Million adult Americans
c. 20 Million adult Americans
Answer: b. 6 Million Adult Americans 138. Cholesterol is formed in:
a. Liver
b. Gallbladder
c. Pancreas
Answer: a. Liver 139. The age group among automobile drivers in which the fewest fatal accidents occurred per miles driven is:
a. 25 to 29 years
b. 45 to 49 years
c. 50 to 54 years
Answer b. 45 to 49 years 140. The site of the greatest number of non-athletic injuries in colleges and universities is:
a. Dormitories
b. Laboratories
c. Auditoriums
Answer a. Dormitories 141. Transportation is most dangerous in:
a. Automobiles
b. Trains
c. Air flights
Answer: a. Automobiles 142. For accidental poisoning in children under 5 years of age the most frequently ingested substance is:
a. Bleach
b. Aspirin
c. Detergents
Answer: b. Aspirin 143. The leading cause of fatal home accidents is:
a. Firearms
b. Poisonings
c. Falls
Answer: c. Falls 144. Accidental death rates are higher in:
a. Males
b. Females
Answer: a. Males 145. Part of the body most frequently injured in disabling injuries:
a. Thumbs and fingers
b. Head
c. Trunk
Answer: c. Trunk 146. Eye screening programs to prevent blindness in adults is primarily for early detection of:
a. Glaucoma
b. Myopia
c. Astigmatism
Answer: a. Glaucoma 147. Skin cancer may arise or result from:
a. Senile keratosis
b. Radium burns
c. All of the above
Answer: c. All of the above 148. To detect the toxin of botulism in foods by:
a. Odor
b. Taste
c. Both odor and taste
Answer: c. Both odor and taste 149. Factors influencing accident rates in industry:
a. Type of occupation
b. Fatigue
c. Personality make-up
Answer: b. Fatigue 150. What is a vaccine:
a. A product that will give protection against certain disease
b. A respiratory disease
c. Germ
Answer: a. A product that will give protection against certain disease 151. Rabies is a disease spread by:
a. Humans
b. Animals
c. Plants
Answer: b. Animals 152. When a person is bitten by an animal with rabies, he should:
a. Take aspirin
b. Lay down and rest
c. Go immediately to a physician for vaccine
Answer: c. Go immediately to a physician for vaccine 153. For minor first degree burns, to help ease the pain and lessen damage caused by a minor burn put the burned part at once in:
a. Warm water
b. Cold Water
c. Hot water
Answer: b. Cold water 154. Neurology is a branch of medical science that deals with:
a. Nervous system
b. Heart
c. Lungs
Answer: a. Nervous system 155. Stroke is a:
a. Sudden loss of brain function
b. Type of ultraviolet radiation
c. Infection disease
Answer: a. Sudden loss of brain function 156. The brain is made up of:
a. Thousands of nerve cells
b. Millions of nerve cells
c. Billions of nerve cells
Answer: c. Billions of nerve cells 157. The human brain weighs about:
a. 1 Pound
b. 3 Pounds
c. 5 Pounds
Answer: b. 3 Pounds 158. The biggest and main portion of the brain is called the:
a. Carotid
b. Enteritis
c. Cerebrum
Answer c. Cerebrum 159. Headaches affect about
a. 40 Thousand Americans
b. 40 Million Americans
c. 400 Thousand Americans
Answer: b. 40 Million Americans 160. Hypertension is:
a. The name of a plant species
b. Persistently high blood pressure
c. Sexually transmitted disease
Answer: b. Persistently high blood pressure 161. In adults it is generally agreed high blood pressure is:
a. 140/90
b. 120/80
c. 95/60
Answer: a. 140/90

162. Senses of smell and possible taste:
a. Decreases with age
b. Increases with age
c. Does not change with age
Answer: a. Decreases with age 163. The most common psychologic factor affecting appetite a. Hallucination
b. Depression
c. Schizophrenia
Answer: b. Depression 164. Compared to other adults, older Americans have a:
a. Higher economic status
b. Equal economic status
c. Lower economic status
Answer: c. Lower economic status 165. Compared to younger adults, older persons have:
a. Lower calorie intake
b. Higher calorie intake
c. Equal calorie intake
Answer: a. Lower calorie intake 166. Compared to younger persons, older persons especially have a higher occurrence of:
a. Obesity
b. Fractures
c. High blood pressure
Answer: b. Fractures 167. Alzheimer's disease is a:
a. Neurodegenerative syndrome
b. Heart disease
c. Lung disease
Answer: a. Neurodegenerative syndrome 168. Alzheimer's disease affects:
a. 100,00 Americans
b. 20,000 Americans
c. 2 to 3 Million Americans
Answer: c. 2 to 3 Million Americans It will be appreciated by those familiar with the art that the game described herein above is not limited to the playing according to the above described set of rules but may be played with any suitable set of rules or procedures. Furthermore, it is appreciated that rules may be devised for the game which may or may not incorporate the use of the playing cards as indicated herein. Furthermore, the game may be played without the use of the health cards as indicated herein.

In summary, it will be appreciated that the game described herein is not limited to specific embodiment shown and described herein and above but rather defined only by the claims which follow. Additionally, it will be apparent to those skilled in the art that various modifications can be made to the health game of the instant invention without departing from the scope or spirit of the invention and it is intended that the present invention cover modifications and variations of the health game provided they come within the scope of the appended claims and their equivalent.

I claim:

1. A game board comprising:

manually manipulable means bearing indicia for making a chance selection;

a plurality of playing pieces each representing a player;

a plurality of health question cards containing player questions;

a game board having a playing surface thereon;

a first series of playing locations defined about said playing surface in substantially contiguous relationship having a shape of an octagon, comprising a playing path wherein said playing pieces are moved in discrete steps between successive locations;

a second series of playing locations defined about said playing surface in substantially contiguous relationship having the shape of an octagon, and located within said first series of playing locations, comprising a playing path wherein said playing pieces are moved in discrete steps between successive locations, and wherein said first series of playing locations include at least one location that a player whose piece lands therein is to move to the second series of playing locations;

a third series of playing locations defined about said playing surface in substantially contiguous relationship having the shape of an octagon, and located within said first and second series of playing locations, comprising a playing path wherein said playing pieces are moved in discrete steps between successive locations, and wherein said second series of playing locations include at least one location that a player whose piece lands thereon is to move to the third series of playing locations; and wherein said first, second and third series of playing locations includes a first plurality of locations indicating that a player whose piece lands thereon contracts a health problem and a second plurality of locations indicating that a player whose piece lands thereon obtains a preventive health care certificate indicating attributes of health which may be used to avoid a health penalty.

2. The board game as set forth in claim 1 further comprising:

a match card containing a plurality of health problems, a plurality of preventive health care methods, and a plurality of preventive health care certificates.

3. A board game comprising:

manually manipulable means bearing indicia for making a chance selection;

a plurality of playing pieces each representing a player;

a game board having a playing surface thereon;

a first series of playing locations defined about said playing surface in substantially contiguous relationship comprising a playing path in which said playing pieces are moved in discrete steps between successive locations;

a second series of playing locations defined about said playing surface in substantially contiguous relationship and located within said first series of playing locations, comprising a playing path wherein said playing pieces are moved in discrete steps between successive locations;

a third series of playing locations defined about said playing surface in substantially contiguous relationship and located within said first and second series of playing locations, comprising a playing path wherein said playing pieces are moved in discrete steps between successive locations; and wherein said first, second and third series of playing locations includes a first plurality of locations indicating that a player whose piece lands thereon contracts a health problem and a second plurality of locations indicating that a player whose piece lands thereon obtains a preventive health care certificate indicating attributes of health which may be used to avoid a health penalty.

4. The board game as set forth in claim 3 further comprising:

a plurality of health question cards containing player questions related to health.

5. The board game as set forth in claim 3 wherein said first series of playing locations include at least one location that a player whose piece lands thereon is to move to the second series of playing locations.

6. The board game as set forth in claim 5 wherein said second series of playing locations include at least one location that a player whose piece lands thereon is to move to the third series of playing locations.

7. The board game as set forth in claim 3 further comprising:

a match card containing a plurality of health problems, a plurality of preventive health care methods, and a plurality of preventive health care certificates.

8. A board game comprising:

manually manipulable means bearing indicia for making a chance selection;

a plurality of playing pieces each representing a player;

a game board having a playing surface thereon;

a first series of playing locations defined about said playing surface in substantially contiguous relationship having a shape of an octagon, comprising a playing path wherein said playing pieces are moved in discrete steps between successive locations;

a second series of playing locations defined about said playing surface in substantially contiguous relationship having the shape of an octagon, and located within said first series of playing locations, comprising a playing path wherein said playing pieces are moved in discrete steps between successive locations;

a third series of playing locations defined about said playing surface in substantially contiguous relationship having the shape of an octagon, located within said first and second series of playing locations, comprising a playing path wherein said playing pieces are moved in discrete steps between successive locations;

wherein said first, second and third series of playing locations includes at least one location indicating that a player whose piece lands thereon contracts a health problem;

at least one location indicating that a player whose piece lands thereon obtains a preventive health care certificate indicating attributes of health which may be used to avoid a health penalty; and at least one location indicating that a player whose piece lands thereon follows a game direction.

9. The board game as set forth in claim 8 further comprising:

a plurality of health question cards indicating attributes of health.

10. The board game as set forth in claim 8 wherein said second series of playing locations include at least one location that a player whose piece lands thereon is to move to the second series of playing locations.

11. The board game as set forth in claim 10 wherein said second series of playing locations include at least one location that a player whose piece lands thereon is to move to the third series of playing locations.

12. The board game as set forth in claim 8 further comprising:

a match card containing a plurality of health problems, a plurality of preventive health care methods, and a plurality of preventive health care certificates.

13. A board game comprising:

manually manipulable means bearing indicia for making a chance selection;

a plurality of playing pieces each representing a player;

a game board having a playing surface thereon;

a series of playing locations defined about said playing surface in substantially contiguous relationship having a shape of an octagon comprising a playing path wherein said playing pieces are moved in discrete steps between successive locations;

wherein said series of playing locations includes at least one location indicating that a player whose piece lands thereon contracts a health problem;

at least one location indicating that a player whose piece lands thereon obtains a preventive health care certificate indicating attributes of health which may be used to avoid a health penalty; and at least one location indicating that a player whose pieces lands thereon follows a game direction.

14. The board game as set forth in claim 13 further comprising:

a plurality of health question cards containing player questions indicating attributes of health.

15. The board game as set forth in claim 13 further comprising:

a match card containing a plurality of health problems, a plurality of preventive health care methods, and a plurality of preventive health care certificates.

* * * * *